US007350940B2

(12) United States Patent
Haugaard et al.

(10) Patent No.: US 7,350,940 B2
(45) Date of Patent: Apr. 1, 2008

(54) OVERHEAD INDUSTRIAL LIGHT FIXTURE WITH THERMAL CHIMNEY CONTIGUOUS TO RECESSED SOCKET

(75) Inventors: Eric Haugaard, Kenosha, WI (US); Kurt Wilcox, Libertyville, IL (US)

(73) Assignee: Ruud Lighting, Inc., Racine, WI (US)

( * ) Notice: Subject to any disclaimer, the term of this patent is extended or adjusted under 35 U.S.C. 154(b) by 83 days.

(21) Appl. No.: 11/196,064

(22) Filed: Aug. 3, 2005

(65) Prior Publication Data

US 2007/0030686 A1 Feb. 8, 2007

(51) Int. Cl.
*F21V 29/00* (2006.01)

(52) U.S. Cl. ..... 362/294; 362/265; 362/264; 362/373

(58) Field of Classification Search ..... 454/300, 454/292, 293; 362/265; 95/273
See application file for complete search history.

(56) References Cited

U.S. PATENT DOCUMENTS

| | | | | |
|---|---|---|---|---|
| 3,692,977 | A * | 9/1972 | Duhamel et al. | 392/347 |
| 4,379,321 | A * | 4/1983 | Plemmons et al. | 362/267 |
| 4,384,316 | A * | 5/1983 | de Vos et al. | 362/147 |
| 4,535,386 | A | 8/1985 | Frey, Jr. et al. | |
| 4,600,979 | A | 7/1986 | Fisher et al. | |
| 4,630,182 | A * | 12/1986 | Moroi et al. | 362/294 |
| 4,858,089 | A | 8/1989 | Pietro | |
| 5,443,625 | A * | 8/1995 | Schaffhausen | 95/113 |
| 5,664,872 | A * | 9/1997 | Spearman et al. | 362/96 |
| 5,687,527 | A * | 11/1997 | Bikard et al. | 52/506.08 |
| 5,879,232 | A * | 3/1999 | Luter et al. | 454/349 |
| 6,095,671 | A | 8/2000 | Hutain | |
| 6,193,603 | B1 * | 2/2001 | Tai | 454/300 |
| 6,350,046 | B1 * | 2/2002 | Lau | 362/364 |
| 6,394,869 | B1 | 5/2002 | Haugaard et al. | |
| 6,467,927 | B1 | 10/2002 | Haugaard et al. | |
| 6,601,975 | B1 | 8/2003 | Haugaard et al. | |
| 2001/0009514 | A1 * | 7/2001 | Quiogue et al. | 362/368 |
| 2003/0210549 | A1 * | 11/2003 | Sears et al. | 362/265 |

* cited by examiner

*Primary Examiner*—Anabel M Ton
(74) *Attorney, Agent, or Firm*—Jansson Shupe & Munger Ltd.

(57) ABSTRACT

In an overhead industrial light fixture of the type including a housing with a base member and a top member forming a space, the base member forming a socket-receiving recess, and power-related components in the space, portions of the housing form a vertical airflow thermal chimney immediately adjacent to the recess and extending through the housing from bottom to top, to facilitate heat transfer to the chimney and heat-dissipating airflow to the atmosphere. The base member and top member are preferably formed of die-cast metal. A variety of preferred features are disclosed.

14 Claims, 7 Drawing Sheets

OVERHEAD INDUSTRIAL LIGHT FIXTURE WITH THERMAL CHIMNEY CONTIGUOUS TO RECESSED SOCKET

FIELD

The field relates generally to overhead industrial light fixtures, and more specifically to overhead industrial light fixtures having high-intensity discharge lamps.

BACKGROUND

Many different overhead industrial light fixtures exist to serve needs such as factory and warehouse illumination and the like, and a number of advances have been made over the years. Among significant advances in industrial light fixtures are the fixtures disclosed in U.S. Pat. No. 6,601,975 (Overhead Industrial Light Fixture With Two-Piece Housing); U.S. Pat. No. 6,394,869 (Method for Manufacture of Overhead Industrial Light Fixture); and U.S. Pat. No. 6,467,927 (Overhead Industrial Light Fixture With Mounted Reflector), all of Ruud Lighting, Inc. Such fixtures provide significant advantages, including compactness, simplicity of manufacture, ease of installation and service, pleasing appearance, and other advantages set forth in the disclosures.

Despite these and other such advances in the field there remains a need for further improvement in industrial light fixtures, preferably without compromising the advantages previously provided including those related to ease of manufacture, storage, shipment, installation, etc.

Overheating is a common problem for industrial light fixtures, and among the overheating problems with certain devices of the prior art is a problem of inadequate heat dissipation away from power-related components such as ballasts, lamps and lamp sockets. Certain components, particularly capacitors, are limited in their ability to tolerate high temperatures. It is critical to the life of certain components, mainly those that are particularly heat-sensitive, that steps be taken to prevent costly damage or, worse, a premature end of the life of the fixture. Overheating can damage power-related components which compromises the longevity of the light fixture and its components. Minimal gains in temperature reduction yield very substantial gains in component life and, therefore, in overall fixture longevity.

While the concern of overheating has in some cases been addressed by use of cooling fans, such fans are often loud and contrary to the highly desirable goals of fixture compactness, low cost, and operational reliability. Similarly, use of barriers and other insulating features have disadvantages as they increase manufacturing costs and also defeat the goal of compactness and ease of service. Plastic ballast enclosures may be used to thermally isolate the ballast; however, such enclosures are contrary to heat removal and can exacerbate problems.

In some cases, thermal protection devices to break circuits upon overheating are utilized. However, under certain conditions such devices may fail to perform properly, thereby allowing a lighting fixture to overheat and possibly lead to combustion. Such thermal protection devices also add cost.

Another possible approach to dealing with certain of the above problems and shortcomings is use of a housing with one or more external power-related components, such as the ballast. However, this approach complicates installation, increases cost, makes achieving a pleasing appearance difficult at best, and is directly contrary to the goal of compactness.

Another problem is that certain structures of the prior art may not be particularly well-adapted to suppress and/or contain any combustion that might occur. In certain cases, the nature of the ballast (including manufacturing defects or minimal defects that may occur from handling or the like) or improper electrical characteristics or conditions can lead to ballast failures and shorts which in turn lead to combustion of materials (e.g., organic insulation materials). As can be seen, the goals of achieving cooling and suppressing oxidation in an overhead industrial light fixture tend to be at odds with each other. Accomplishing one of these critical goals tends to lead to loss of the other. The benefits realized in being able to accomplish these two goals in one fixture would be significant.

For one thing, facilitating cooling of the industrial light fixture tends to keep the components cool thereby enhancing the life of the components and the entire fixture and preserving overall quality. And, substantially reducing the inflow and outflow of combustion-supporting air in critical portions of an overhead industrial light fixture would tend to suppress and limit any combustion which might occur, and thus reduce dangers typically associated with product failures. If these critical advantages could be combined in an overhead lighting fixture, the resulting fixture would have improved quality, endurance and longevity.

Accordingly, there remains in the art a need to provide an overhead industrial light fixture that more effectively removes heat from the housing, without sacrificing other advantages of benefits realized from earlier development work.

OBJECTS

It is an object to provide an improved overhead industrial light fixture overcoming some of the problems and shortcomings of the prior art.

Another object is to provide an overhead industrial light fixture which facilitates dissipation of heat from the housing of the overhead industrial light fixture into the atmosphere.

Another object is to provide an overhead industrial light fixture in which air infiltration is restricted to prevent combustion.

Another object is to provide an overhead industrial light fixture which is well-adapted to contain any combustion that might occur.

Another object is to provide an improved overhead industrial light fixture that is inexpensive to manufacture and easy to install.

Still another object is to provide an improved overhead industrial light fixture which is compact and yet free of problems of overheating critical components.

SUMMARY

This invention is an improvement in overhead industrial light fixtures of the type which include: a housing having a base member and a top member together forming a space, the base member having an upwardly-extending middle portion integral therewith which forms a recess; power-related components in the space; and a lamp-mounting socket in the recess. In the improvement, portions of the housing form a vertical airflow thermal chimney immediately adjacent to the recess and extending through the housing from bottom to top, whereby heat transfer to the chimney and heat-dissipating airflow to the atmosphere are facilitated. The socket temperature drives convection of the air flow through the chimney.

In highly preferred embodiments, the thermal chimney and the recess together form a contiguous open space, i.e., the chimney and the recess are not isolated from one another by a wall. In some other embodiments, the chimney and the recess can include a common wall therebetween which isolates the recess from the chimney immediately adjacent thereto.

It is most preferred that both the base member and the top member are formed of die-cast metal. In particularly preferred die-cast structures, the base member and the top member are configured to provide mating engagement thereby forming a substantially enclosed space.

The base member preferably includes an annular lower chimney portion terminating in a top edge. The top member includes an annular upper chimney portion terminating in a lower edge and adjoining the top edge.

In highly preferred embodiments, the housing includes first and second opposite endwalls. The middle portion of the base member and the thermal chimney together divide the space into a first region adjacent to the first endwall and a second region adjacent to the second endwall. In such embodiment, power-related components include a capacitor in the first region and a ballast in the second region.

It is most preferred that the top member is hinged with respect to the base member at one of the endwalls. The base member and top member have first and second mating hinge members each integrally formed therewith along adjacent edges thereof.

As used herein, the following terms have the meanings given below, unless the context requires otherwise:

In referring to an overhead industrial light fixtures, the term "overhead" refers to fixtures which are typically mounted, directly or indirectly, on ceilings or overhead structural members of some sort, such as in factories, warehouses, etc. (regardless of purpose), or any other overhead structure put in place for the purpose of supporting a light fixture. The term "industrial" is used in order to differentiate from residential lighting or the like. Neither of these terms is to be taken as limiting.

The term "power-related components" includes ballasts, capacitors, ignitors and other devices for creating the proper electrical power usable for a selected lamp, such as high-intensity discharge (HID) lamps of various kinds.

The term "substantially enclosed," as used with respect to space within the housing, means closed in the sense that inflow and outflow of air are impeded even if the space is not fully sealed. The impeding of air flow is such as would serve to suppress combustion if it were to occur.

The terms "top" and "base" used herein with reference to the fixture, or parts thereof, assume the normal use orientation of the fixture. The simplicity of the housing retains certain advantages, including ease of manufacturing and service, compactness, pleasing in appearance, and ease of assembly, as disclosed in U.S. Pat. No. 6,394,869 (Method For Manufacture of Overhead Light Fixture).

The overhead industrial light fixture described herein, in its various forms, overcomes certain problems and shortcomings of the prior art, including those referred to above.

BRIEF DESCRIPTION OF THE DRAWINGS

The drawings illustrate preferred embodiments which include the above-noted characteristics and features of the overhead industrial light fixture described herein. The invention will be readily understood from the descriptions and from the drawings, in which.

DETAILED DESCRIPTION OF PREFERRED EMBODIMENTS

Figure 1:
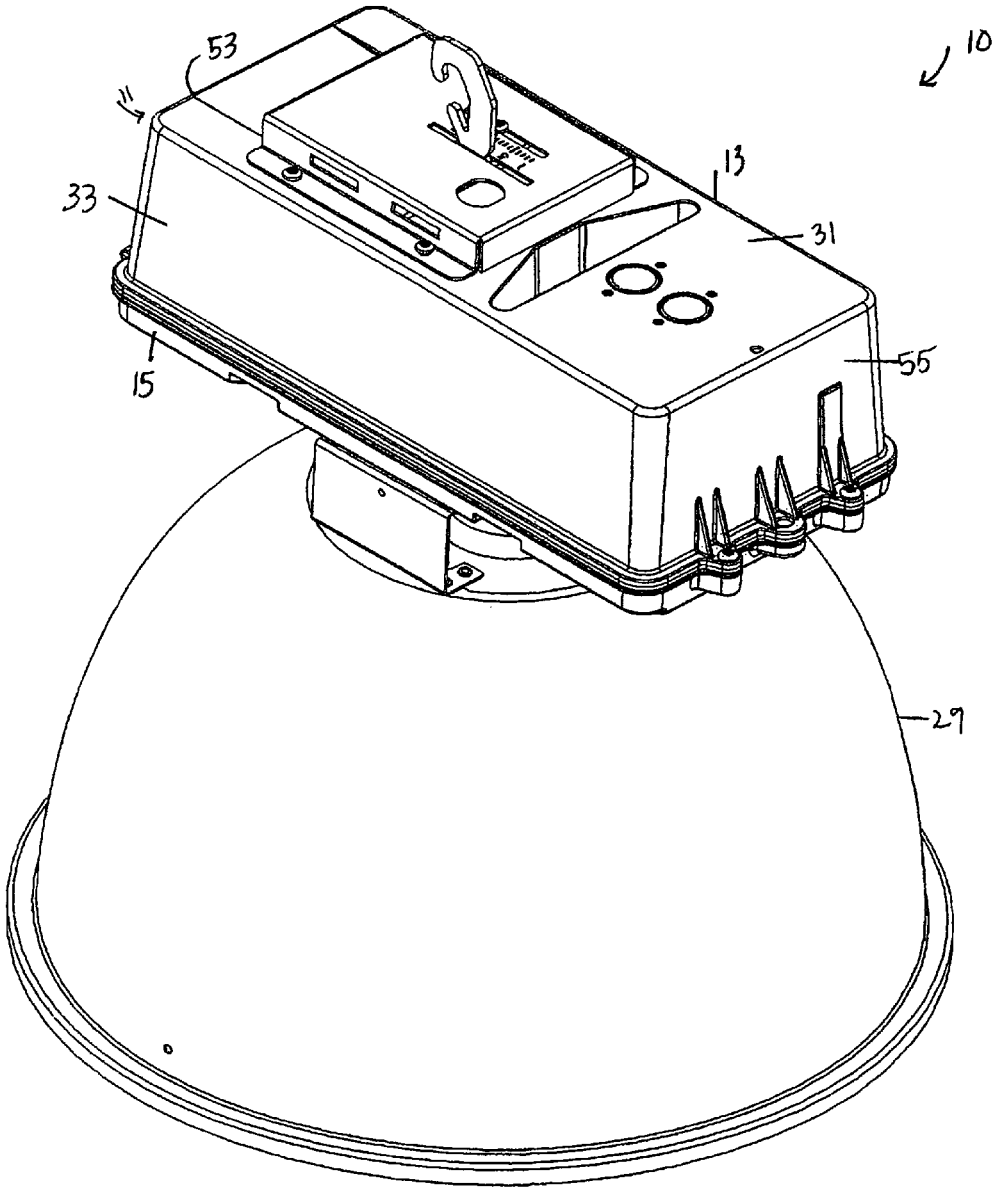
FIG. 1 is a perspective view of a preferred industrial light fixture in accordance with this invention.

The drawings illustrate an overhead industrial light fixture 10 which includes: a housing 11 with a top member 13 and a base member 15; power-related components including a ballast 17, a capacitor 19, and an ignitor 21; spring-spacer apparatus 23; a socket mount 25; a lamp-mounting socket 27; and a reflector 29. Such elements are best seen in FIGS. 1 and 2.

Figure 2:
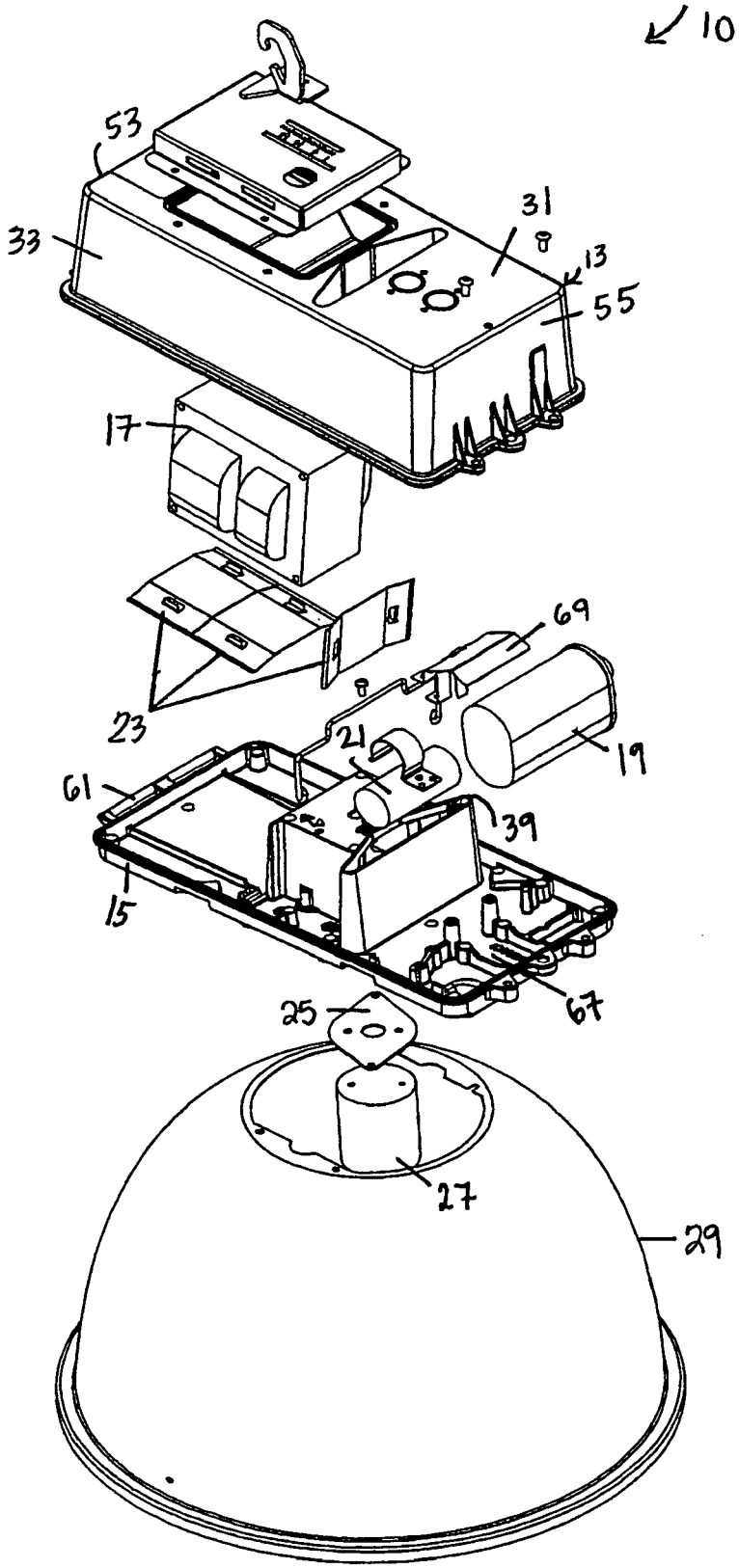
FIG. 2 is an exploded perspective view of the device of FIG. 1.
Figure 3:
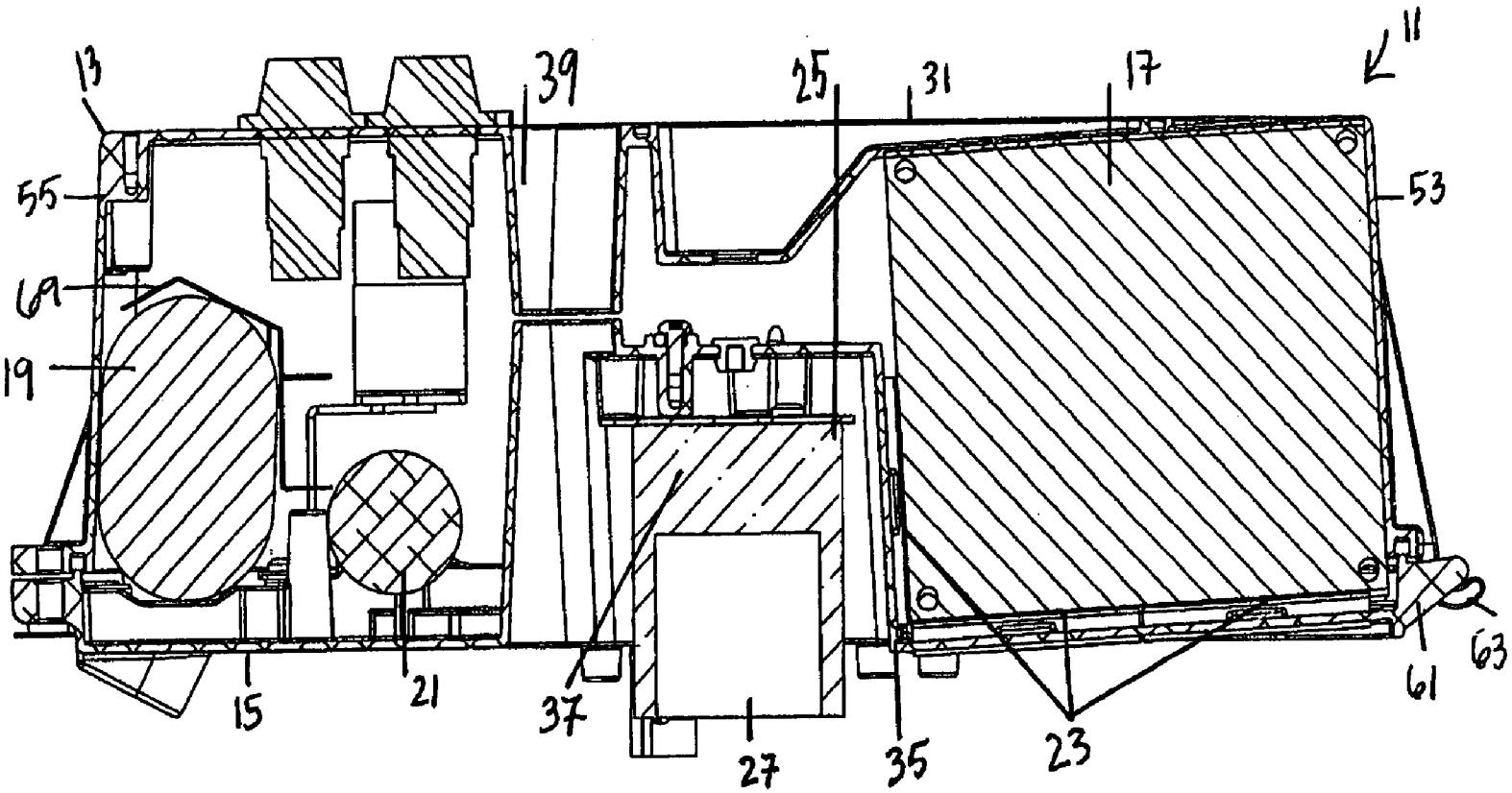
FIG. 3 is a cross-section of the housing of the device in FIG. 1.

As seen in FIGS. 1 and 3, in one aspect of the invention base member 15 and top member 13, each formed of die-cast metal, are configured to provide mating engagement thereby forming a substantially enclosed space.

Figure 4:
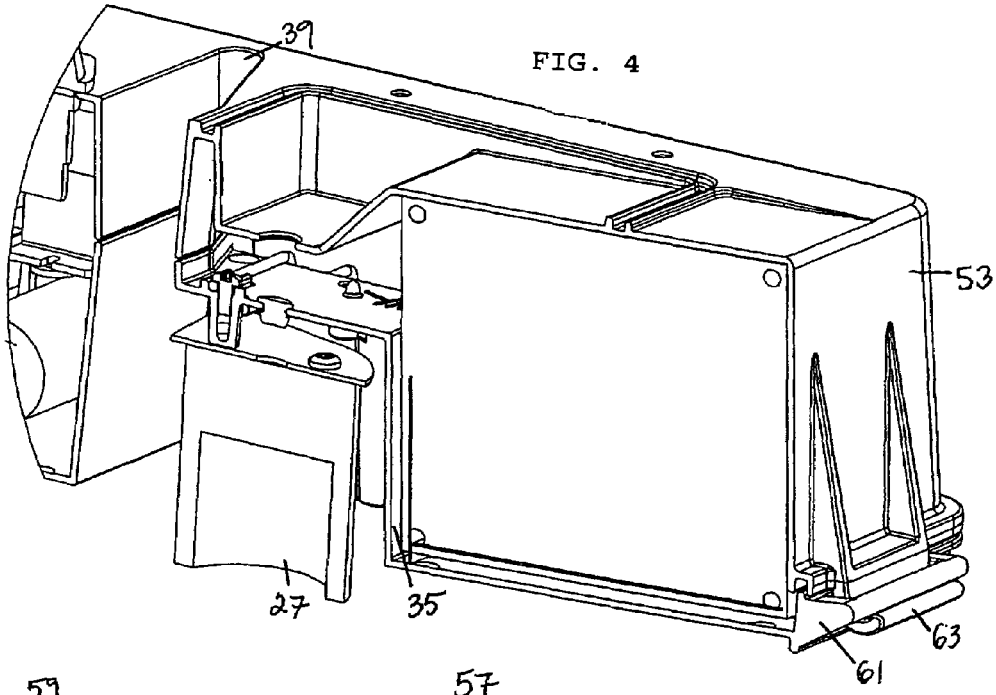
FIG. 4 is a partial cross-section of the housing of the device in FIG. 1.
Figure 5:
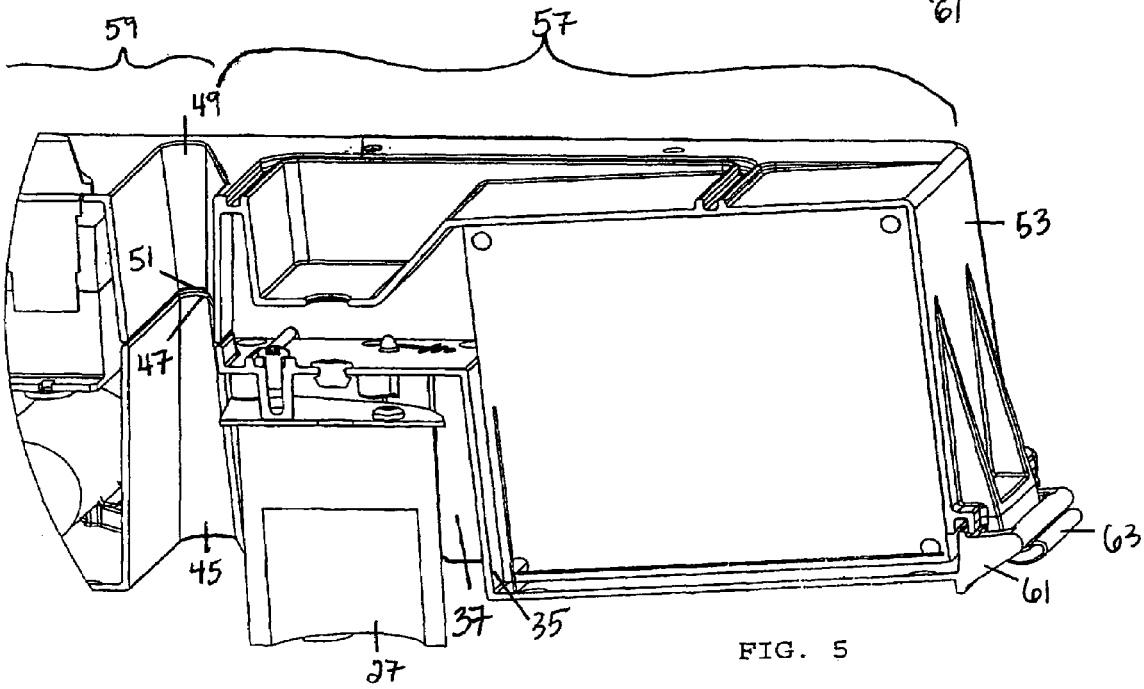
FIG. 5 is further partial cross-section of the housing of the device in FIG. 1.
Figure 6:
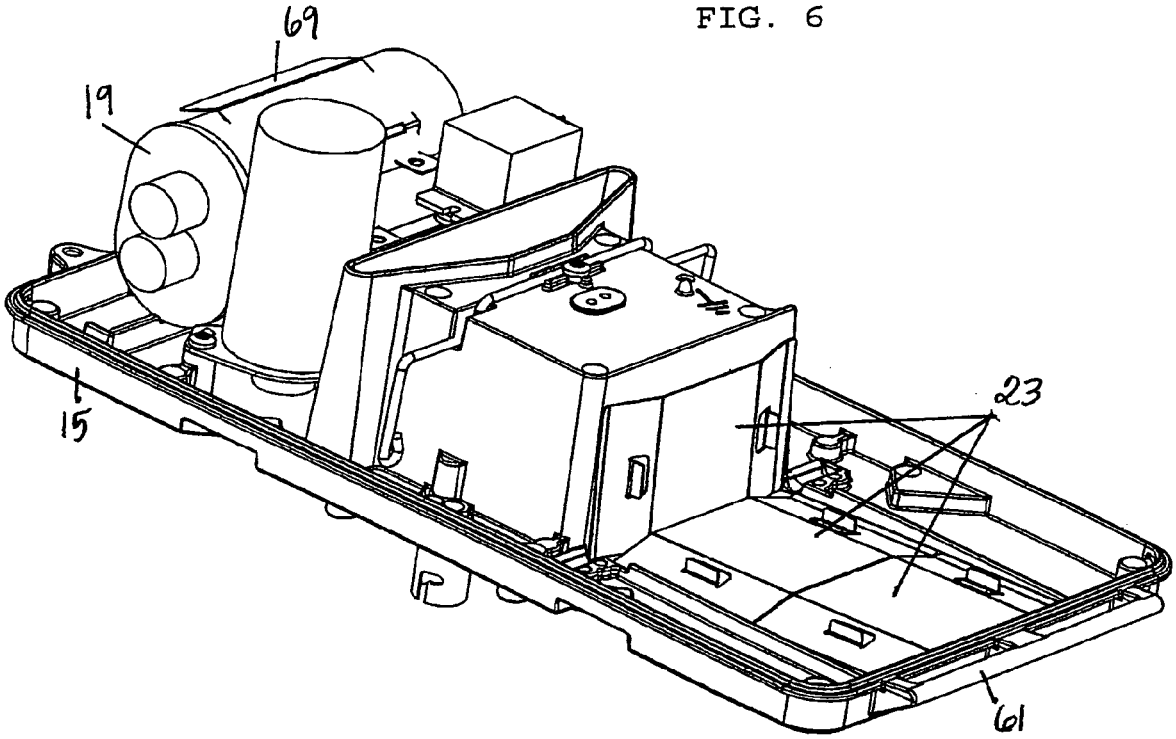
FIG. 6 is a top perspective view of the base member of the housing of the device of FIG. 1.
Figure 7:
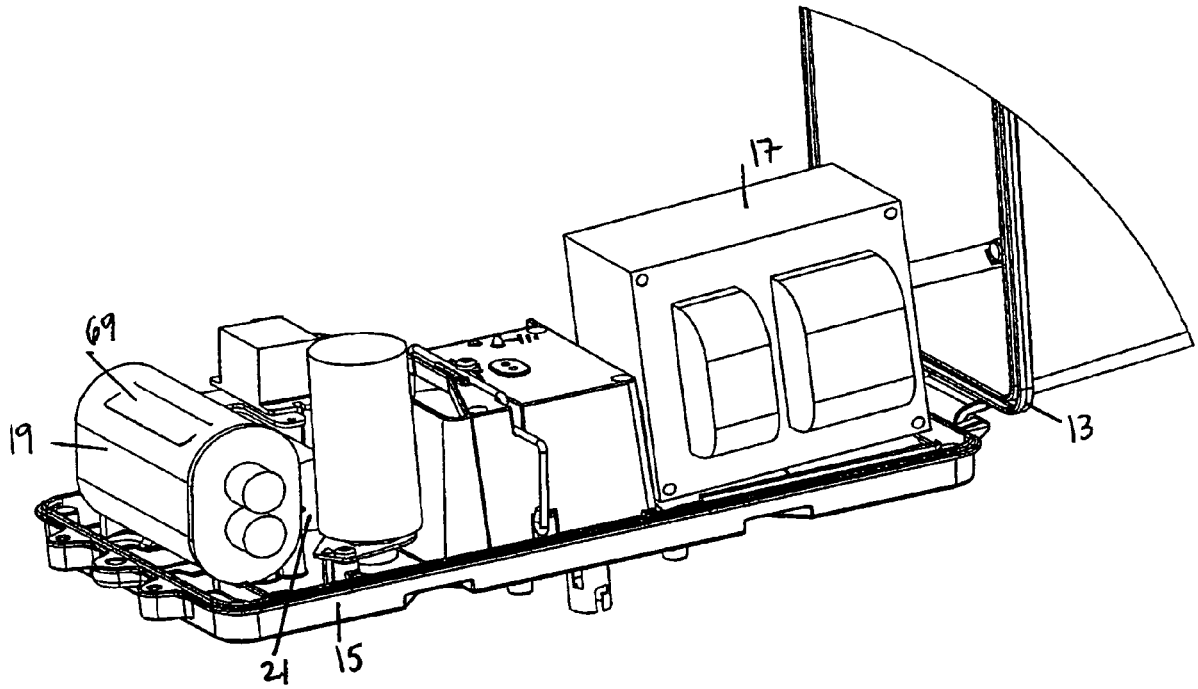
FIG. 7 is yet another perspective view of the base member of the housing of the device of FIG. 1.
Figure 8:
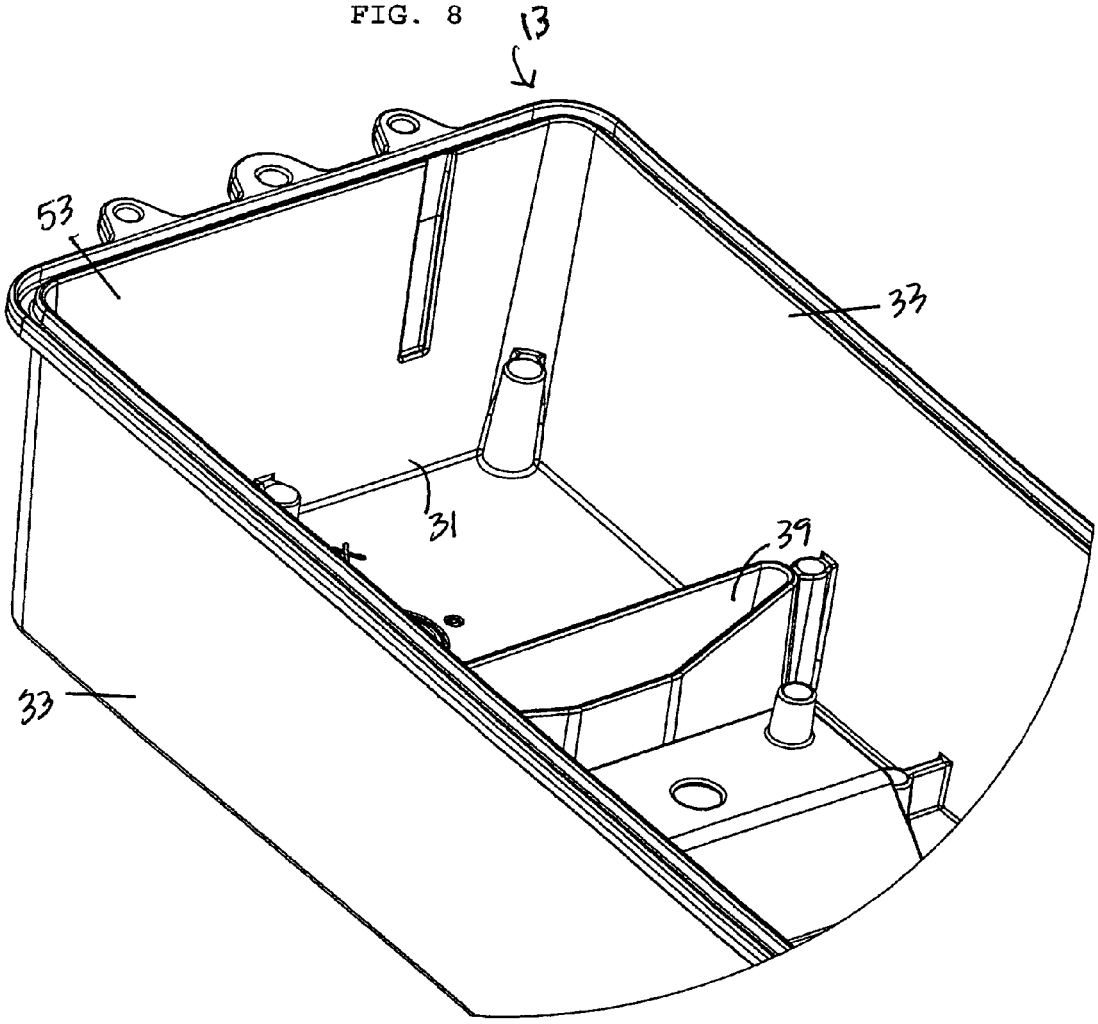
FIG. 8 is a partial view of the inside of the top member of the housing of the device of FIG. 1.

Referring to FIGS. 3-5, this embodiment employs housing 11 having top and base members, 13 and 15, respectively, and together top and base members form a space. Top member 13 includes a top wall 31 and downwardly-extending, space-surrounding sidewalls 33 integral with top wall 31. Base member 15 has a first upwardly-extending middle portion 35 integral therewith which forms a housing recess 37.

In one aspect of the invention, portions of housing 11 form a vertical airflow thermal chimney 39, FIGS. 3-5 and 8, immediately adjacent to recess 37. Vertical airflow thermal chimney 39 extends through housing 11 from bottom to top whereby heat transfer to thermal chimney 39 and heat-dissipating airflow to the atmosphere are facilitated.

Referring next to FIGS. 3 and 5, in this embodiment base member 15 includes an annular lower chimney portion 45 terminating in a top edge 47. Top member 13 includes an annular upper chimney portion 49 terminating in a lower edge 51 adjoining top edge 47.

In another aspect of the invention, housing 11 includes first and second opposite endwalls, 53 and 55 respectively. Middle portion 35 of base member 15 and thermal chimney 39 together divide the space into a first region 57 adjacent to first endwall 53 and a second region 59 adjacent to second endwall 55. Power-related components include ballast 17 in first region 57 and capacitor 19 in second region 59.

Referring further to FIGS. 3-5 and 7, there is shown an embodiment of the invention wherein top member 13 is hinged with respect to base member 15 at one of the endwalls. Base member 15 and top member 13 have first and second mating hinge members, 61 and 63 respectively, each integrally formed therewith along adjacent edges thereof.

Before assembly, top member 13 and base member 15 are formed of die-cast metal. Spring-spacer apparatus 23 are positioned at their assigned locations. Next, ballast 17 is placed at its assigned location and is secured to spring-spacer apparatus 23. Capacitor 19 is positioned at its assigned location on a capacitor bed 67 and is secured to base member 15 by a spring-bracket 69.

Socket mount 25 is secured with respect to base member 15. Socket mount 25 supports lamp-mounting socket 27 within housing 11.

Assembly continues by hingedly connecting top member 13 to base member 15. Base member 15 is then secured to top member 13 by first and second mating hinge members, 61 and 63. This substantially completes assembly of light fixture 10.

Reflector 29 can be attached to light fixture 10 while preparing for installation at a job site. In some cases, however, reflector 29 may be attached to light fixture 10 immediately upon completion of attachment of base member 15 to top member 13.

When assembly is completed, light fixture 10 is ready for packaging and shipment.

The die-cast metal used in forming top member 13 and base member 15 is preferably Aluminum. Acceptable power-related components and other components used in manufacture of light fixture 10 are known to those skilled in the art.

The low profile which is made possible by recessing socket 27 into housing 11 allows the vertical dimension of housing 11 to be as low as 4.5 to 6 inches, even when using electrical components which are standard in overhead industrial light fixtures.

While the principles of this invention have been described in connection with specific embodiments, it should be understood clearly that these descriptions are made only by way of example and are not intended to limit the scope of the invention.

The invention claimed is:

1. In an overhead industrial light fixture of the type including: a housing having a base member and a top member forming a space, the base member including an upwardly-extending middle portion integral therewith which forms a housing recess; power-related components in the space; and a lamp-mounting socket in the recess, the improvement wherein the base member includes an annular lower chimney portion terminating in a top edge and the top member includes an annular upper chimney portion terminating in a lower edge adjoining the top edge, the lower chimney and upper chimney portions together forming a vertical airflow thermal chimney immediately adjacent to the recess and extending through the housing from bottom to top, whereby heat transfer to the chimney and heat-dissipating airflow to the atmosphere are facilitated.

2. The overhead industrial light fixture of claim 1 wherein the thermal chimney and the recess together form a contiguous open space.

3. The overhead industrial light fixture of claim 1 wherein the base member and the top member are each of die-cast metal.

4. The overhead industrial light fixture of claim 3 wherein the base member and the top member are configured to provide mating engagement thereby forming a substantially enclosed space.

5. The overhead industrial light fixture of claim 4 wherein:

the housing includes first and second opposite endwalls;

the middle portion of the base member and the thermal chimney together dividing the space into a first region adjacent to the first endwall and a second region adjacent to the second endwall; and the power-related components include a ballast in the first region and a capacitor in the second region.

6. The overhead industrial light fixture of claim 5 wherein the base member and the top member are each of die-cast metal.

7. The overhead industrial light fixture of claim 6 wherein the base member and the top member are configured to provide mating engagement thereby forming a substantially enclosed space.

8. The overhead industrial light fixture of claim 5 wherein the top member is hinged with respect to the base member at one of the endwalls.

9. The overhead industrial light fixture of claim 8 wherein the base member and the top member have first and second mating hinge members each integrally formed therewith along adjacent edges thereof.

10. The overhead industrial light fixture of claim 9 wherein the base member and the top member are each of die-cast metal.

11. The overhead industrial light fixture of claim 10 wherein the base member and the top member are configured to provide mating engagement thereby forming a substantially enclosed space.

12. In an overhead industrial light fixture of the type including: a housing having a base member and a top member forming a space, the base member including an upwardly-extending middle portion integral therewith which forms a housing recess; power-related components in the space; and a lamp-mounting socket in the recess, the improvement wherein the housing includes first and second opposite endwalls;

the middle portion of the base member and the thermal chimney together dividing the space into a first region adjacent to the first endwall and a second region adjacent to the second endwall; and the power-related components include a ballast in the first region and a capacitor in the second region, and the base member includes an annular lower chimney portion terminating in a top edge and the top member includes an annular upper chimney portion terminating in a lower edge adjoining the top edge, the lower chimney and upper chimney portions together forming a vertical airflow thermal chimney immediately adjacent to the recess and extending through the housing from bottom to top, whereby heat transfer to the chimney and heat-dissipating airflow to the atmosphere are facilitated.

13. The overhead industrial light fixture of claim 12 wherein the thermal chimney and the recess together form a contiguous open space.

14. The overhead industrial light fixture of claim 12 wherein the base member and the top member are each of die-cast metal.

* * * * *